US006145935A

United States Patent [19]

Boucherie

[11] Patent Number: 6,145,935

[45] Date of Patent: Nov. 14, 2000

[54] DEVICE FOR SUPPLYING FIBRES TO A FILLING INSTRUMENT IN A BRUSH MANUFACTURING MACHINE

[75] Inventor: Leonel Polydore Boucherie, Izegem, Belgium

[73] Assignee: Firma G.B. Boucherie, naamloze vennoostchap, Izegem, Belgium

[21] Appl. No.: 09/190,003

[22] Filed: Nov. 12, 1998

[30] Foreign Application Priority Data

Nov. 14, 1997 [BE] Belgium ..... 09700914

[51] Int. Cl.[7] ..... A46D 1/04; A46D 3/04

[52] U.S. Cl. ..... 300/7; 300/2

[58] Field of Search ..... 300/2, 3, 7, 21, 300/4, 5, 9

[56] References Cited

U.S. PATENT DOCUMENTS

| | | | |
|---|---|---|---|
| 3,048,442 | 8/1962 | Anderson | 300/7 |
| 3,107,945 | 10/1963 | Whitman et al. . | |
| 3,606,472 | 9/1971 | Rutkowski et al. . | |
| 3,640,582 | 2/1972 | Zahoransky . | |
| 3,858,941 | 1/1975 | Boucherie . | |
| 4,688,857 | 8/1987 | Boucherie | 300/2 |
| 5,518,301 | 5/1996 | Boucherie | 300/7 |

FOREIGN PATENT DOCUMENTS

| | | | |
|---|---|---|---|
| 0 206 385 | 12/1986 | European Pat. Off. . | |
| 346965 | 12/1989 | European Pat. Off. | 300/2 |
| 0 681 796 | 11/1995 | European Pat. Off. . | |
| 352294 | 4/1922 | Germany | 300/7 |
| 604274 | 10/1934 | Germany | 300/7 |
| 1028969 | 4/1958 | Germany | 300/7 |
| 2 128 774 | 10/1972 | Germany . | |
| 44 11 652 | 10/1995 | Germany . | |

*Primary Examiner*—Gary K. Graham
*Attorney, Agent, or Firm*—Bacon & Thomas, PLLC

[57] ABSTRACT

A device for supplying fibers to a filling instrument of a brush manufacturing machine which contains a fiber cartridge with at least two fiber supply ducts. The device is provided with a drawer with loading spaces which are used to move the fibers coming from the fiber cartridge to a bundle remover and work in conjunction with the filling instrument. Between each fiber supply duct in association with the fiber cartridge and the drawer, the device is provided with a loading device which makes is possible for certain loading spaces to work exclusively with certain fiber supply ducts.

24 Claims, 4 Drawing Sheets

DEVICE FOR SUPPLYING FIBRES TO A FILLING INSTRUMENT IN A BRUSH MANUFACTURING MACHINE

BACKGROUND OF THE INVENTION

1. Field of the Invention

The present invention concerns a device for supplying fibres to a filling instrument of a brush manufacturing machine, in particular a device of the type which contains a fibre cartridge with at least two fibre supply ducts on the one hand, and which is provided with a drawer with loading spaces which are used to move the fibres coming from the fibre cartridge to a bundle remover working in conjunction with the above-mentioned filling instrument on the other hand.

2. Description of the Related Art

A device of the above-mentioned type is known from EP 0.206.385 owned by the assignee of this invention. Although this known device provides good results, it is disadvantageous in that it is only suitable for the supply of maximum two types of fibres.

Another type of device is known from EP 0.681.796. For the selective supply of the fibres from the fibre cartridge, use is hereby made of moveable closing devices working in conjunction with the ends of the fibre supply ducts which, thanks to their movement, make it possible for the bundle remover of the filling instrument to remove fibres from only one of the fibre supply ducts during every cycle. Since the fibre supply ducts are hereby situated with their ends directly along the path followed by the bundle remover, and since such bundle remover is relatively small, the number of fibre supply ducts which can be erected along this path is in practice limited to two.

Some known types of devices can be extended with several fibre supply ducts, but they are disadvantageous in that they have a complex construction, a larger inertia and sometimes there is a risk of the different types of fibres being mingled. The complexity of the construction hereby has a direct impact on the cost price and the user-friendliness of the brush manufacturing machine. The large inertia restricts the switching frequency, in other words the switching between different sorts of fibres. The mixing of different sorts of fibres is inadmissible from an aesthetic point of view for the product to be manufactured, in other words the brush to be manufactured.

SUMMARY OF THE INVENTION

Thus, the present invention concerns a device for supplying fibres to the filling instrument of a brush manufacturing machine whereby one or several of the above-mentioned disadvantages are excluded.

To this end, the invention concerns a device of the above-mentioned type, characterized in that between each fibre supply duct concerned of the fibre cartridge and the above-mentioned drawer, a device is provided which make it possible for certain loading spaces to work exclusively with certain fibre supply ducts.

The above-mentioned device offers the advantage that the drawer can be moved along different fibre supply ducts with its loading spaces without the fibres being mixed and that the loading spaces and fibre supply ducts can be selectively connected to one another.

According to a preferred embodiment, the number of loading spaces of the drawer will be larger than the number of fibre supply ducts. In particular, the number of loading spaces is preferably at least double the number of fibre supply ducts. This offers the advantage that there are several loading spaces per type of fibre, so that it becomes possible to supply similar fibres to the drawer during the removal of fibres from the drawer by way of the bundle remover. This makes it possible to work with relatively small loading spaces, which offers the advantage that the drawer only has to carry out small movements, which promotes the operational speed of the device.

According to a preferred embodiment, the above-mentioned device consists of moving, in particular a rotating device which function either as fibre separators and which are provided with a fibre take-up space which can be put in at least two positions, namely one position in which the fibre take-up space is connected to the fibre supply duct concerned on the one hand, and a position in which the fibre take-up space is connected to the side of the drawer in which the above-mentioned loading spaces are provided on the other hand, or are provided with a passage duct which can be put in at least two positions thanks to the movement of the moveable element, namely a position in which a connection is formed between the fibre supply duct and the drawer, and a position in which this passage duct is separated from the drawer, so that the above-mentioned connection is interrupted.

By making use of rotating elements for the above-mentioned device, the whole can be made very compact, so that the inertia losses can also be restricted.

The device also offers the advantage that no large masses have to be removed thanks to the use of relatively simple rotating parts, so that the operational speed is higher than in the known devices, which offers as an additional advantage that an almost unlimited number of fibres can be processed.

BRIEF DESCRIPTION OF THE DRAWINGS

In order to better explain the characteristics of the invention, the following preferred embodiments are described as an example only, without being limitative in any way, with reference to the accompanying drawings, in which.

DETAILED DESCRIPTION OF THE INVENTION

Figure 1:
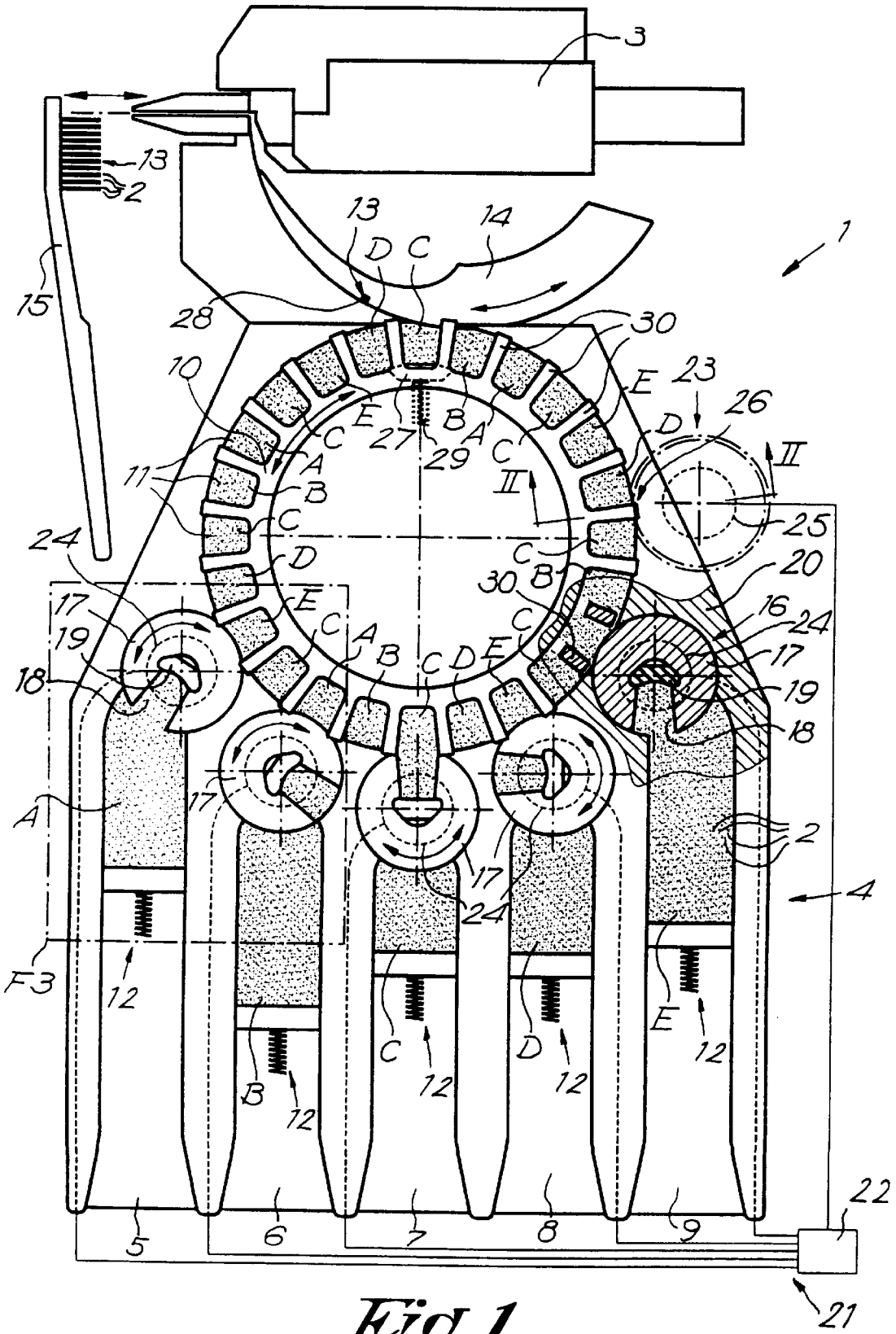
FIG. 1 shows a device according to the invention, as seen from above.

As is represented in FIG. 1, the invention concerns a device 1 for supplying fibres 2 to a filling instrument 3 in a brush manufacturing machine.

The device 1 contains a fibre cartridge 4 with at least two and in this case five fibre supply ducts 5-6-7-8-9 and a drawer 10 with loading spaces 11. The fibre cartridge 4 is provided in the known manner with press-on device 12 for the fibres 2. The fibre supply ducts 5-6-7-8-9 can be filled with different fibres 2, whereby these fibres 2 can be of different sorts, by which is implied that the fibres 2 can have different dimensions and/or can be of a different colour and/or of a different nature. The difference between the fibres 2 is schematically indicated in FIG. 1 with the letters A-B-C-D-E.

The drawer 10 is constructed and arranged such that fibre bundles 13 can be taken out of it by a bundle remover 14 known as such, which puts these fibre bundles 13 into the filling instrument 3, whereby the latter in turn inserts said fibre bundles 13 in a brush body 15. The bundle remover 14 and the filling instrument 3 are driven in the known way, which is not represented here.

In the example of FIG. 1, the drawer 10 according to the invention is circular-shaped and it can rotate around its centre, either by way of rotations which are always carried out in the same direction or by way of rotations to and fro. The loading spaces 11 are hereby adjacent to the circumference of the circular drawer 10 with their open sides. The fibre supply ducts 5-6-7-8-9 are erected along the outer perimeter of the drawer 10.

The number of loading spaces 11 of the drawer 10, in this case twenty-four in number, are preferably considerably larger than the number of fibre supply ducts 5-6-7-8-9, in this case five in number.

The invention is unique in that between each fibre supply duct 5-6-7-8-9 and the drawer 10, a loading device 16 is provided which makes it possible for certain loading spaces 11 to work exclusively in conjunction with certain fibre supply ducts.

The loading device 16 includes moving elements 17, in particular rotating elements which can act as fibre separators and which are each provided with at least one fibre take-up space 18 which, as a result of the rotation of the element 17 concerned, can be put in at least two positions, namely a position in which the fibre take-up space 18 concerned is connected to the accompanying fibre supply duct on the one hand, and a position in which the fibre take-up space 18 is connected to the outside of the drawer 10, in other words the side in which the above15 mentioned loading spaces 11 open on the other hand.

The fibre take-up spaces 18 are each provided with a press-on device so as to obtain that the fibres 2 provided therein are put under pressure and, as will be described hereafter, can be pushed from the fibre take-up space 18 in a loading space 11. In the given example, the press-on device consists of end parts 19 made of an elastic, deformable material, such as rubber.

It should be noted that, according to a variant which is not represented here, the press-on device can also be carried out in another way. For example, the end parts 19 may also consist of elements made of a non-deformable material which are mounted such that they can move in relation to the elements 17, whereby these end parts are then pressed against the fibres 2 with a device which can be elastically pressed in, for example springs, air cylinders, rubber pieces or such.

Also, the press-on device can be carried out such that the pressure on the fibres 2 in the take-up spaces 18 can be reduced or entirely removed when fibres 2 have to be taken up from the corresponding fibre supply duct 5-6-7-8 or 9. Conversely, the pressure on the fibres 2 in the take-up space 18 can also be increased when fibres 2 have to be carried to a corresponding loading space 11, and this also by a suitable press-on device which is driven for example by a control or whose pressure varies as a function of the angular position of the element 17 concerned.

It should be noted that the various parts operate mainly in one and the same plane and that they are confined by a basic element 20 which prevents the fibres 2 from coming out of the fibre supply ducts 5-6-7-8-9, the fibre take-up spaces 18 or the loading spaces 11. This basic element also provides for a supporting plate over which the fibres 2 shift.

Further, the device 1 is provided with a coupling device 21 with which the drawer 10 on the one hand and the above-mentioned loading device 16 on the other hand, in other words the rotating elements 17, are mutually connected to one another coordinated movement, such that, thanks to a suitable drive of the drawer 10 and the elements 17, only fibres of a particular sort are supplied to each of the loading spaces 11.

The coupling device 21 in this case consists of a control 22 with which the drives 23 and 24, for controlling the drawer 10 and for controlling the loading device 16 respectively, in particular the rotation of the moveable elements 17, is controlled. The drive 23 consists for example, as is schematically represented, of a stepping motor or servomotor 25 which provides for the rotation of the circular drawer 10 by way of a gear wheel transmission 26. Each of the drives 24 preferably also consists of a stepping motor or servomotor with which the corresponding element 17 can be driven. The latter stepping motors or servomotors are erected for example under the elements 17.

Further, the whole is equipped with a press-on element 27 with which the fibres 2 of every loading space 11 positioned in front of the bundle remover 14 can be put under pressure, so that fibres 2 are pressed in the recess 28 of the bundle remover 14. The press-on force of this press-on element 27 is supplied by a spring 29.

Figure 2:
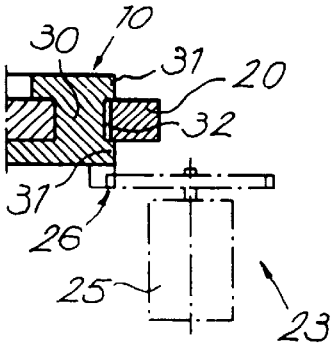
FIG. 2 shows a section according to line II—II in FIG. 1.

For practical reasons, several of the parts moving along each other can be made overlapping as seen from above so as to prevent the fibres 2 from penetrating between these parts. As represented in FIG. 2, the partition walls 30 which separate the different loading spaces 11 from one another also have parts 31 which extend over the edge of the basic element 20. In these partition walls 30 are moreover provided with recesses 32, so that the rotation of the drawer 10 is not impeded by the fact that the elements 17 are partly situated inside the circular opening of the basic element 20 in which the drawer 10 is provided.

Figure 3:
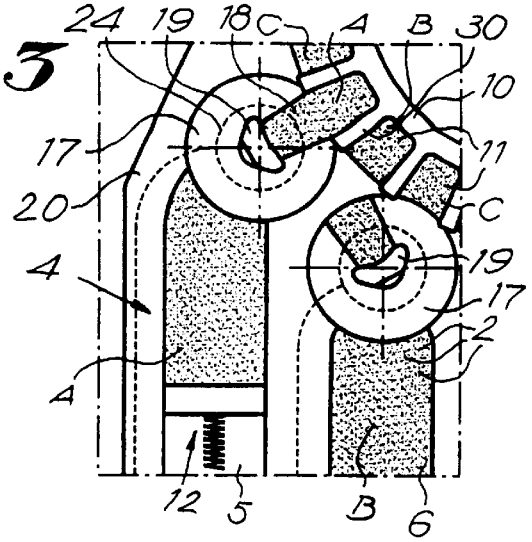
FIG. 3 shows the part indicated in FIG. 1 with F3, but for another position.

The working of the device from FIG. 1 can be easily derived from FIGS. 1 and 3 and is further described for the first fibre supply duct 5.

By putting the element 17 which belongs to the fibre supply duct 5 in a position as represented in FIG. 1, fibres 2 from the fibre supply duct 5 are pressed in the accompanying fibre take-up space 18 thanks to the force delivered by the press-on device 12. The press-on force of the press-on device 12 is hereby selected such that not only is the fibre take-up space 18 filled with fibres 2, but also the end part 19 concerned is elastically pressed in.

By rotating the drawer 10 and by putting it opposite the above-mentioned element 17 together with a certain loading space 11 to be filled up and by putting this element 17 with its fibre take-up space 18 in the position of FIG. 3, part of the fibres 2 of the fibre take-up space 18 is pressed in the opposite loading space 11 with the help of the spring force exerted by the end part 19.

Thanks to the rotation of the drawer 10 and the exact positioning thereof, fibres 2 of the desired sort—A, B, C, D or E—can be presented to the bundle remover 14 in every working cycle of the filling instrument. At the moment when a loading space 11 is positioned in front of the bundle remover 14, the fibres 2 which are present in this loading space 11 are pressed against the bundle remover 14 by the above-mentioned press-on element 27, such that a fibre bundle 13 can be separated.

It is clear that it is possible to work with relatively little loading spaces 11 and fibre take-up spaces 18, so that the movements to be carried out by the drawer 10 can be kept very restricted, as a result of which different loading spaces 11, and consequently different sorts of fibres 2, can be successively presented to the bundle remover 14 in a very fast manner. Since several loading spaces 11 can be provided per sort of fibre 2, this offers the advantage that the drawer 10 can be filled up with a specific sort of fibres 2, whereas fibres 2 of the same sort can be taken from the drawer 10 by the bundle remover 14.

The number of loading spaces 11 does not have to be the same for every sort of fibres 2. Thus, several loading spaces 11 can be provided for a type of fibres 2 of which a larger number is used. Thus, the switching frequency of the moveable elements 17 may also vary between the moveable elements 17.

It is clear that the above-mentioned coupling device 21, as well as the drives 23–24, can also be of a different nature. Thus it is not excluded to couple the drawer and the moveable elements 17 by way of a mere mechanical transmission, such as a gear wheel transmission or a belt transmission. Use can also be made of coupling device and/or drives of a pneumatic or hydraulic nature.

As was made clear before, the transmission ratio or the regularity of the movement between the drive device of the drawer 10 and the moveable elements 17 does not have to be the same for all moveable elements 17.

Figure 4:
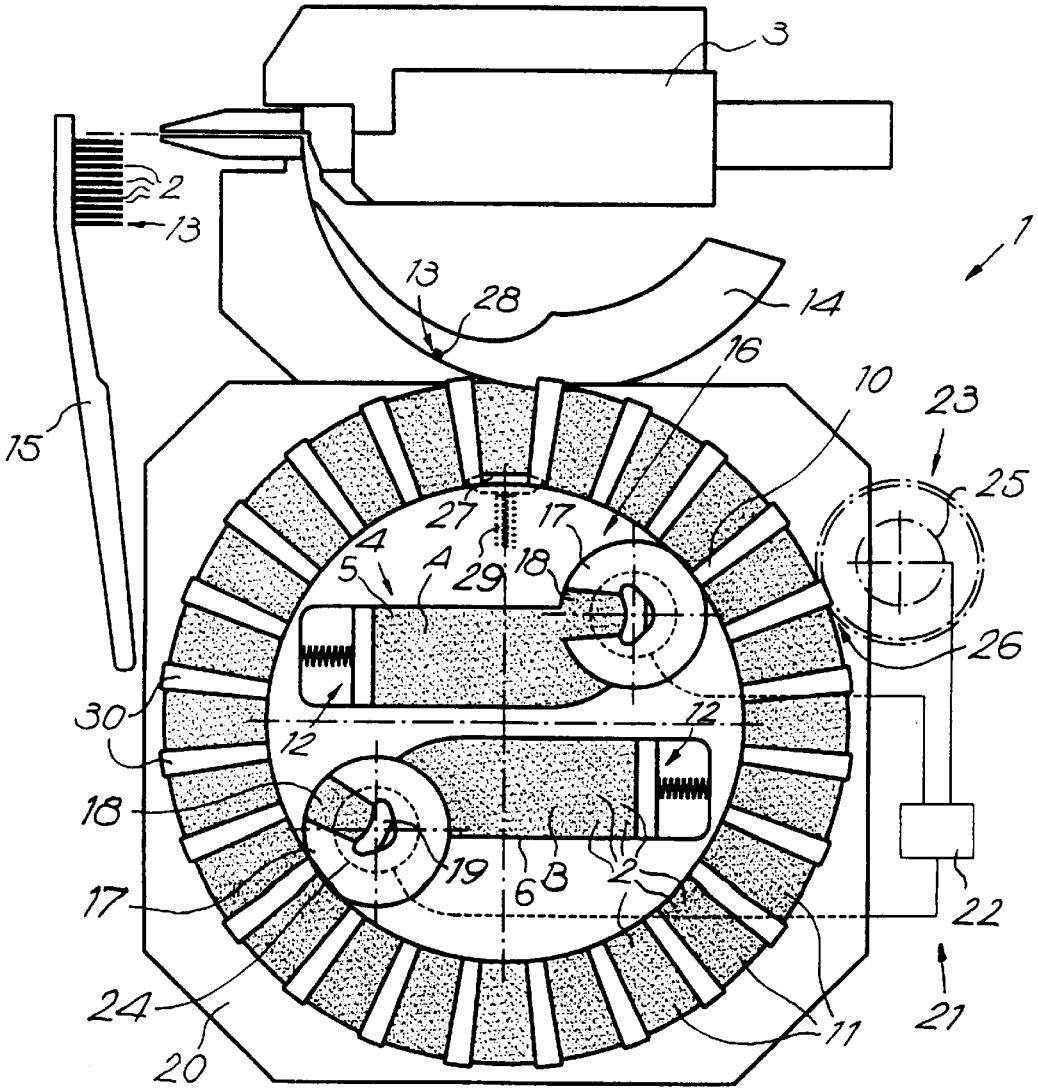
FIGS. 4, 5 and 6 show variants of the device of FIG. 1.

FIG. 4 represents a variant in which use is also made of a rotating drawer 10. A major difference, however, with the embodiment of FIG. 1 consists in that the fibre supply ducts, in this case two ducts, 5 and 6 respectively, and the above-mentioned loading device 16, in particular the elements 17, are located within the circularly arranged loading spaces 11 of the drawer 10. Thus is obtained a very compact design.

Another major difference consists in that the loading spaces 11 are made in the shape of passage ducts which can cooperate with the above-mentioned fibre supply ducts 5 and 6 with one end, via the elements 17, and which can cooperate with the bundle remover 14 with their other ends. This offers the advantage that the fibres 2 are always moved forward through the loading spaces 11, such that no fibre masses are formed in these loading spaces 11 which never reach the bundle remover 14.

Figure 5:
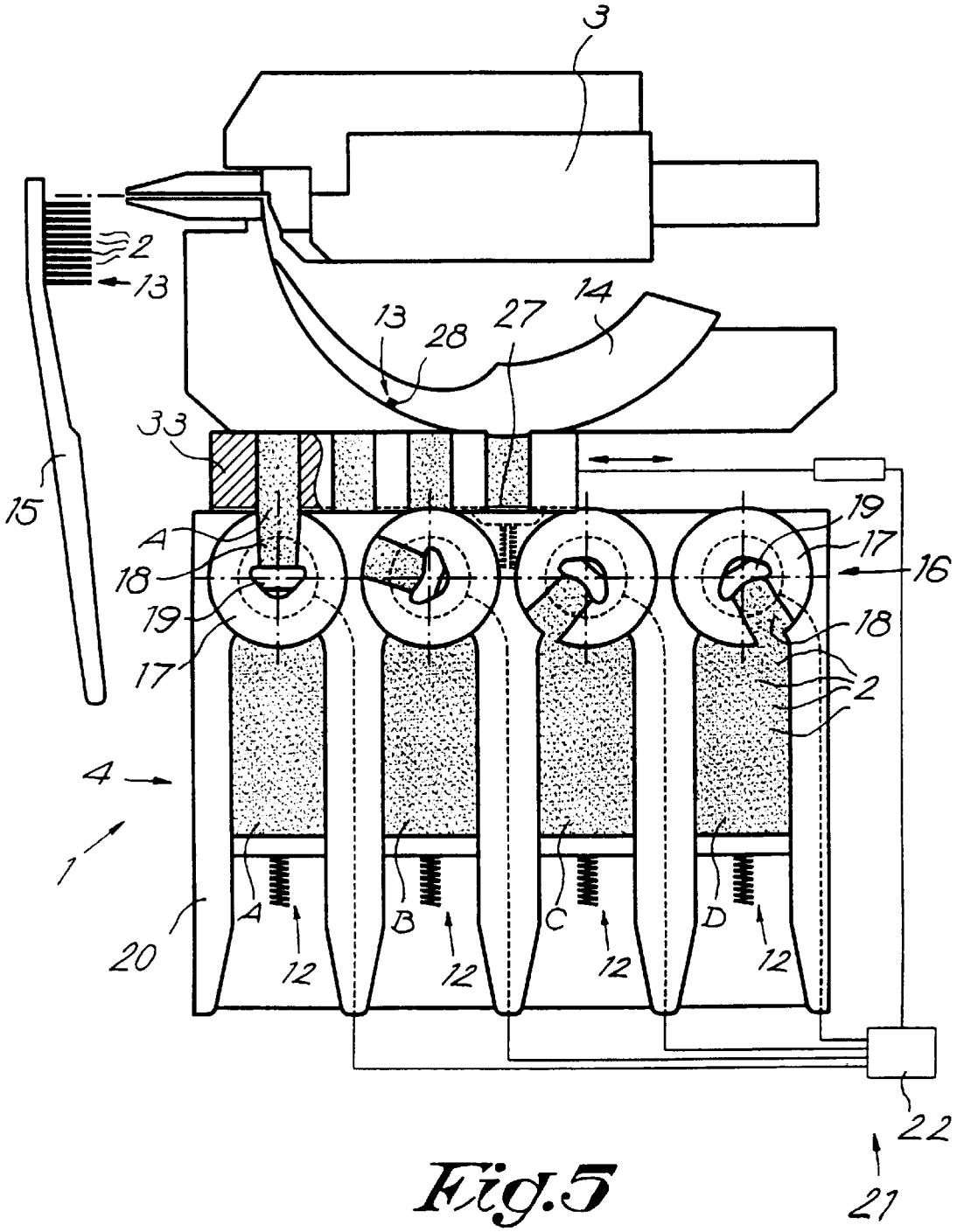

FIG. 5 shows a variant in which, instead of a rotating drawer 10, use is made of a straight drawer 33. The rotating elements 17 are in this case arranged in one line along the drawer 33. The drive 23 of the drawer 33 consists of a linear displacement mechanism.

The working of the embodiment of FIG. 5 is analogous to the working of the embodiment of FIG. 4, the difference being that the drawer 33 is moved to-and-fro instead of being rotated.

Figure 6:
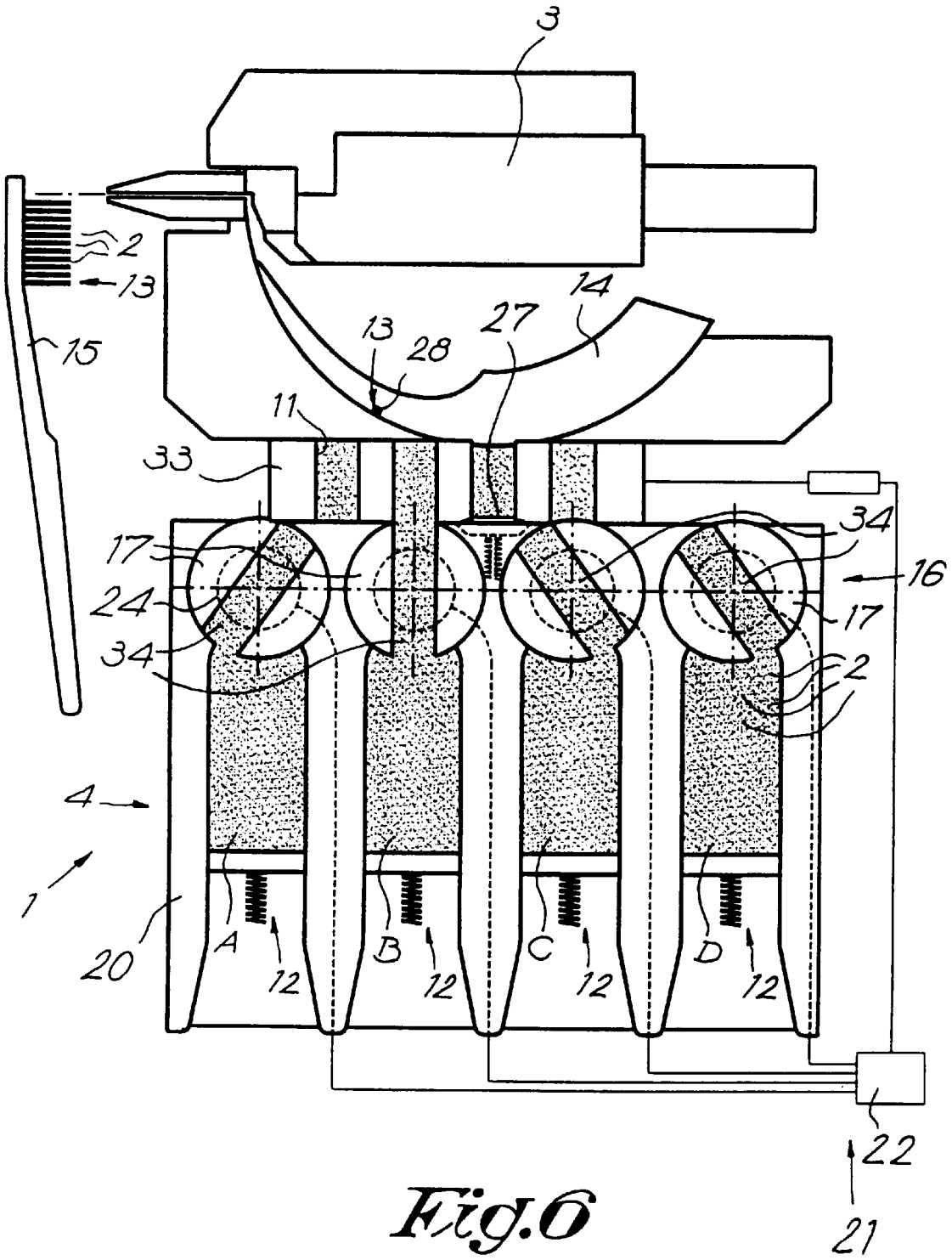

FIG. 6 shows a variant of the embodiment of FIG. 5, in which use is also made of a straight drawer 33, but in which the above-mentioned loading device 16 in this case consists of elements 17 which are provided with a passage duct 34 which, as the element 17 moves, in particular rotates, can be placed in at least two positions, namely a position in which a connection is formed between the fibre supply duct 5, 6, 7 or 8 concerned and the drawer 33, and a position in which this passage duct 34 is blocked from the drawer 33, so that the above-mentioned connection is interrupted.

The working of the embodiment of FIG. 6 is practically analogous to the working of that of FIG. 5, with the only difference being that the fibres 2 must not first be taken up in the elements 17 and subsequently be pressed out of these elements again after these elements 17 have been put in another position, but the fibres can now be pressed from the fibre supply duct 5, 6, 7 or 8 in the loading space 11 concerned in a single movement. This offers the advantage that the press-on device, such as the above-mentioned end parts 19, can be omitted. Another advantage consists in that all fibres 2 always move forward and that no fibre masses are formed anywhere which remain in the same place for a long time or practically permanently.

It is clear that the elements 17 of FIG. 6 can also be applied in the embodiments of FIGS. 1 and 4.

It is also clear that instead of a straight drawer 33 use can also be made of a drawer with a finite length which is not straight, for example which is bent, and which can rotate to and fro over a certain arch segment.

The present invention is by no means restricted to the embodiments described as an example and represented in the accompanying drawings; on the contrary, such a device for supplying fibres to a filling instrument can be made according to all sorts of variants while still remaining within the scope of the invention.

What is claimed is:

1. A device for supplying fibres to a filling unit of a brush manufacturing machine, the device comprising:

a fibre cartridge having at least two individual fibre supply ducts, each of the supply ducts arranged to store fibres;

a moveable drawer having individual loading spaces, the drawer being configured to receive fibres from said individual supply ducts into the individual loading spaces and to move the fibres from the cartridge to a bundle remover for transfer to a filling unit;

at least one loading device associated with each fibre supply duct and operable to transfer fibres from its associated supply duct to one or more of the spaces of the drawer; and a control device operable to control the movements of the loading devices and the drawer such that fibres from an individual fibre supply duct may be transferred into its respective loading device and then into selected individual ones of said loading spaces of said drawer by the loading devices.

2. The device according to claim 1, wherein the drawer is circular-shaped with an outer circumferential perimeter and is rotatably mounted;

the loading spaces are located along the perimeter of the drawer;

the at least two fibre supply ducts and their associated loading devices are positioned along a portion of the outer perimeter of the drawer.

3. The device according to claim 1, wherein the drawer is circular-shaped and includes an outer circumferential perimeter, and is rotatably mounted;

and wherein said loading spaces are located along the perimeter of the drawer; and the at least two fibre supply ducts and their associated loading devices are located adjacent a portion of the perimeter of the drawer with the loading devices located between the loading spaces and the fibre supply ducts.

4. The device according to claim 3, wherein each of the loading spaces of the drawer is shaped as a passage duct having first and second ends, the first end located to receive fibres from a fibre supply duct and the other end located to transfer fibres to a transfer device.

5. The device according to claim 1, wherein the drawer extends along a finite drawerlength, and is reciprocally movable to transferfibres from individual loading devices to a filling unit.

6. The device according to claim 5, wherein each of the loading spaces of the drawer is shaped as a passage duct having first and second ends, the first end arranged to receive fibres from a fibre supply duct and the second end arranged to deliver fibres to a bundle remover.

7. The device according to claim 1, wherein the loading devices include at least one moveable element with at least one fibre take-up space, the moveable element being movable between a first position at which the fibre take-up space is connected to a fibre supply duct and a second position at which the fibre take-up space is connected to a side of the drawer at which the loading spaces are positioned.

8. The device according to claim 7, wherein the fibre take-up space includes an entrance and is provided with a press-on device that exerts pressure on the fibres in a direction of the entrance to the take-up space.

9. The device according to claim 8, including a pressure adjusting device operable to vary the pressure exerted by the press-on device on the fibres in the fibre take-up space in response to whether the take-up space is connected to one of the loading spaces of the drawer or to it respective fibre supply duct.

10. The device according to claim 9, wherein the press-on device includes an end part provided in the take-up space, the end part being moveable relative to the movable element and being elastically deformable when fibres are pressed into the take-up space.

11. The device according to claim 8, wherein the press-on device includes an end part provided in the take-up space, the end part being movable relative to the moveable element and is elastically deformable when fibres are pressed into the take-up space.

12. The device according to claim 1, wherein the loading devices include moveable elements which are each provided with a passage duct, the passage duct being moveable to at least two positions by the movement of the moveable element, the first position locating the passage duct in communication between a fibre supply duct and the drawer, the second position locating the passage duct out of communication with at least the drawer.

13. The device according to claim 1, wherein each loading device comprises a rotatable element.

14. The device according to claim 1, wherein the number of loading spaces of the drawer exceeds the number of fibre supply ducts.

15. The device according to claim 14, wherein the number of loading spaces of the drawer is at least double the number of fibre supply ducts.

16. The device according to claim 1, including a movement coordinating coupling device connecting the drawer and loading devices for coordinated movement.

17. The device according to claim 16, including a coupling device controller, and wherein the coupling device is controlled by said controller to vary the relative movements between the drawer and the loading devices, and wherein the drawer and loading devices are controlled to move in a similar manner.

18. The device according to claim 16, including a coupling device controller, and wherein the coupling device is controlled by said controller to vary the relative movements between the drawer and the loading devices, and wherein the drawer and loading devices are controlled to move in different ways.

19. The device according to claim 16, wherein the coupling device comprises a device selected from the group consisting of a mechanical coupling, a motion drive controller and a drive motor controller.

20. The device according to claim 19, wherein the coupling device is a mechanical coupling and comprises a gear wheel or a belt transmission.

21. The device according to claim 19, wherein the coupling is a drive motor controller and each drive motor is an electrical motor.

22. The device according to claim 21, wherein the electrical motors are stepping or servo motors.

23. The device according to claim 16, wherein the coupling device is a pneumatic or hydraulic device.

24. The device according to claim 1, including a press-on element operable to press the fibres out of the loading spaces into a bundle remover.

* * * * *